US005704229A

United States Patent [19]

Coakley et al.

[11] Patent Number: 5,704,229

[45] Date of Patent: Jan. 6, 1998

[54] PROCESS AND APPARATUS FOR PRODUCING NITROGEN

[75] Inventors: Vincent Coakley, Franklin Township; Robert A. Mostello, Somerville, both of N.J.

[73] Assignee: The BOC Group, Inc., New Providence, N.J.

[21] Appl. No.: 769,025

[22] Filed: Dec. 18, 1996

[51] Int. Cl.[6] ..... F25J 3/00

[52] U.S. Cl. ..... 62/646; 62/651

[58] Field of Search ..... 62/646, 651

[56] References Cited

U.S. PATENT DOCUMENTS 5,207,067 5/1993 Acharya ..... 62/651

5,222,365 6/1993 Nenov ..... 62/651

5,363,657 11/1994 Naumovitz ..... 62/646

*Primary Examiner*—Ronald C. Capossela

*Attorney, Agent, or Firm*—David M. Rosenblum; Salvatore P. Pace

[57] ABSTRACT

An air separation process and apparatus employing a single column nitrogen generator. Part of the incoming air stream to be separated is expanded and combined with a waste stream. After partial warming of the combined stream, the combined stream is expanded and then utilized to liquefy part of the incoming air and for refrigeration purposes.

8 Claims, 1 Drawing Sheet

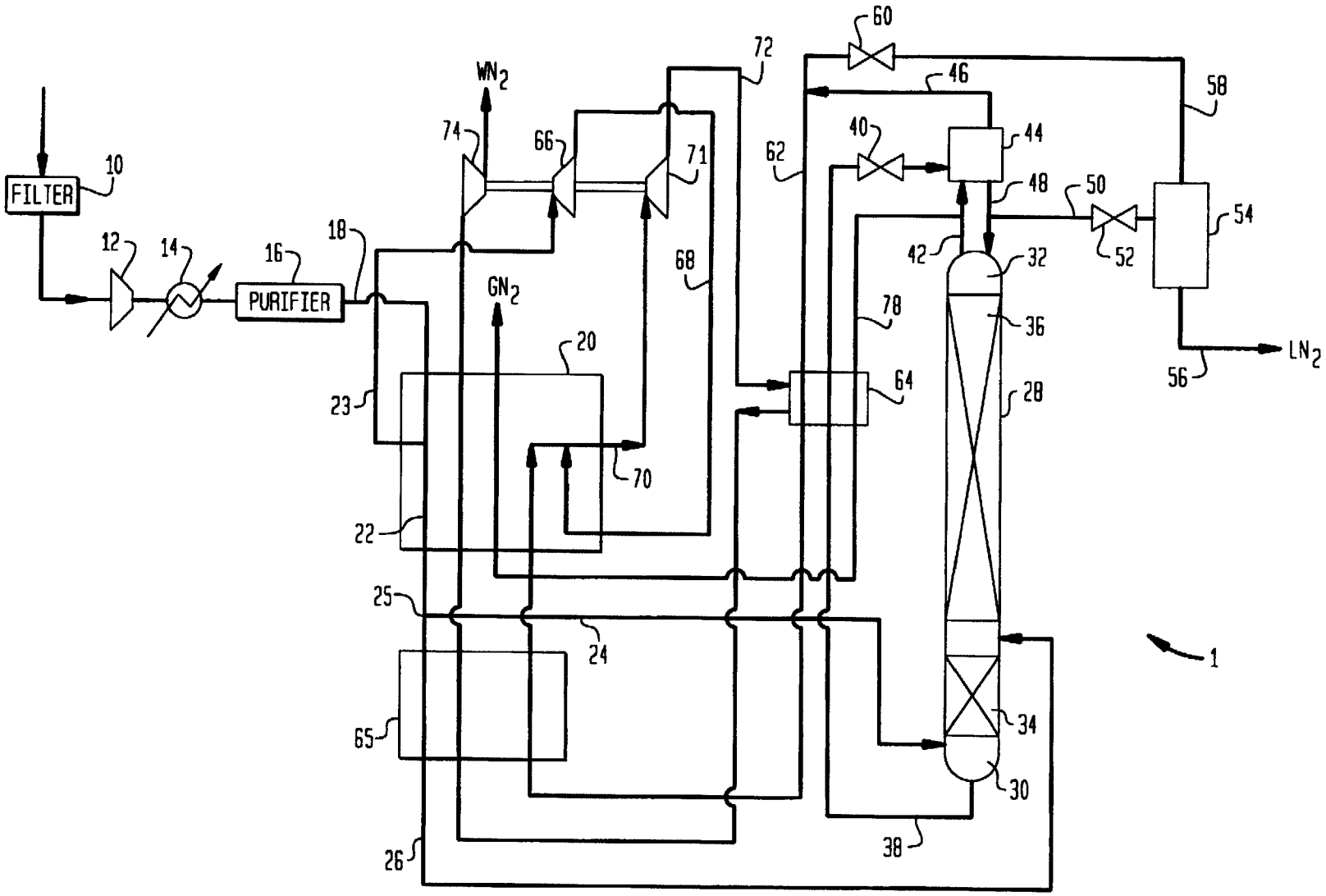
FILTER
PURIFIER
$LN_2$
$GN_2$
$WN_2$
1
10
12
14
16
18
20
22
23
24
25
26
28
30
32
34
36
38
40
42
44
46
48
50
52
54
56
58
60
62
64
65
66
68
70
71
72
74
78

PROCESS AND APPARATUS FOR PRODUCING NITROGEN

BACKGROUND OF THE INVENTION

The present invention relates to a process and apparatus for separating air to produce a nitrogen product in which the air is rectified in a single column nitrogen generator. More particularly, the present invention relates to such a process and apparatus in which at least part of the nitrogen product is drawn as a liquid. Even more particularly, the present invention relates to such a process and apparatus in which increased liquid production is facilitated by expanding part of the incoming air stream, expanding a stream formed by combining a waste stream with the expanded part of the air stream, and using such stream to liquefy part of the incoming air and to refrigerate the process.

Air is separated into its component parts by a wide variety of cryogenic distillation processes that use various combinations of distillation columns. When nitrogen is the object of the distillation, a single column is used which is referred to in the art as a single column nitrogen generator. After filtering of the air to remove dust particles, the air is compressed, cooled to the extent that the heat of compression is removed, and then purified in a prepurification unit to remove water, carbon dioxide and hydrocarbons. Prior to introduction into the single column nitrogen generator, the air is cooled to a temperature suitable for its distillation. The cooling is accomplished against the warming of process streams produced in the distillation.

In any cryogenic distillation, irreversibilities of warm end losses and heat leakage into the system need to be accounted for by the addition of refrigeration. Normally, a waste stream consisting of crude liquid oxygen from the bottom of the column is expanded after having served as a coolant in the reflux or head condenser to the nitrogen generator. The expanded stream is then introduced back into the main heat exchanger in order to lower the enthalpy of the incoming air.

Single column nitrogen generators are well adapted to produce a gaseous product for use at a specific location. If, however, the plant has excess production capacity, at least part of the product can be liquefied for storage or shipment. Liquefaction of more than incidental amounts of nitrogen is commonly effectuated by a nitrogen liquefier. The use of a nitrogen liquefier on an intermittent basis adds substantial equipment cost to the installation.

As will be discussed, the present invention provides an air separation process and apparatus that is inherently capable of liquid production and as such does not require an external liquefier.

SUMMARY OF THE INVENTION

The present invention relates to a process for separating air to produce a nitrogen product. The process includes cooling a first part of a compressed and purified air stream to a temperature suitable for its rectification. The first part of the compressed and purified air stream is divided into first and second subsidiary streams. The second subsidiary stream is liquefied and the first and second subsidiary streams are both introduced into a single column nitrogen generator to produce a tower overhead and a liquid column bottoms. A stream of the tower overhead is condensed to produce a condensate which is in part employed to reflux the single column nitrogen generator. A remaining part of the condensate is used to form a liquid nitrogen product stream. A coolant stream formed from the liquid column bottoms is valve expanded and vaporized against the condensation of the tower overhead to form a vaporized coolant stream. A second part of the compressed and purified air stream is partly cooled to a temperature above the temperature suitable for rectification of the first part of the compressed and purified air stream. Such second part of the compressed and purified air stream is an expanded with performance of work and is then partially warmed together with a waste stream from at least part of the vaporized coolant stream. A combined waste stream is formed by combining and then expanding with the performance of work the second part of the compressed and purified air stream and the waste stream. The combined expanded waste stream is then fully warmed by indirectly exchanging heat from the second subsidiary stream to the combined expanded waste stream, thereby to at least in part liquefy the second subsidiary stream. The combined expanded waste stream is fully warmed by indirectly exchanging further heat from the first and second parts of the compressed and purified air stream, thereby to lower enthalpy of the first and second parts of the compressed and purified air stream.

Thus, the expanded waste stream allows for the production of liquid while at the same time decreasing the enthalpy of the incoming air stream to add the necessary refrigeration. At least part of the nitrogen product, the object of the distillation, is formed from the liquid product nitrogen stream.

In another aspect, the present invention provides an apparatus for separating air to produce a nitrogen product. The apparatus includes a main heat exchange means which is configured for cooling a first part of the compressed and purified air stream to a temperature suitable for its rectification. Such main heat exchange means is also configured for partially cooling a second part of the compressed air stream to a temperature above the temperature suitable for the rectification of the first part of the compressed and purified air stream. Lastly, the main heat exchange means is configured for partially warming the second part of the compressed and purified air stream and a waste stream formed at least in part from the vaporized coolant stream. A junction is provided for dividing the first part of the compressed and purified air stream into first and second subsidiary streams. A liquefaction means is configured to liquefy the second subsidiary stream. A single column nitrogen generator is connected to the junction and the liquefaction means to receive the first and second subsidiary streams and is also configured to produce a tower overhead and a liquid column bottoms. A head condenser is connected to the single column nitrogen generator and is configured to condense a stream of the tower overhead, thereby to produce a condensate, to vaporize a coolant stream formed from the liquid column bottoms, therefore to form the vaporized coolant stream and to return a reflux stream to the single column nitrogen generator. The reflux stream thereby refluxes the single column nitrogen generator from part of the condensate. An expansion valve is interposed between the head condenser and the single column nitrogen generator to valve expand the coolant stream. The first expansion means is provided for expanding the second part of the compressed and purified air stream with the performance of work. A second expansion means is connected to the main heat exchange means for expanding with the performance of work the second part of the compressed and purified air stream and the waste stream for producing a combined waste stream. The liquefier is connected to the second expansion means and the main heat exchange means and the main heat exchange means is connected to the liquefier means. The main heat exchange means and the liquefier means are configured to indirectly exchange heat from the second subsidiary stream to the combined expanded waste stream, thereby to at least in part liquefy the second subsidiary stream. Moreover, the main heat exchange means and liquefier means are also configured to indirectly exchange further heat from the first and second parts of the compressed and purified air stream to the combined expanded waste stream, thereby to lower enthalpy of the first and second parts of the compressed and purified air stream and to fully warm the combined expanded waste stream. A means is connected to the single column nitrogen generator for forming at least part of the nitrogen product from a liquid nitrogen product stream composed of a remaining part of the condensate.

As can be appreciated by those skilled in the art, in order to have a substantial liquid make, liquid must be added to the column. Thus, part of the air stream is liquefied and introduced into the single column nitrogen generator. However, in order to accomplish such liquefaction, more refrigeration must be provided than that would have been required to refrigerate a like air separation. The present invention accomplishes this further refrigeration by further expanding the expanded part of the air and then combining it with a waste stream which is then subsequently expanded. The resultant, expanded combined waste stream can then be used for liquefaction and refrigeration duty prior to its being expelled from the process.

BRIEF DESCRIPTION OF THE DRAWINGS

While the specification concludes with claims distinctly pointing out the subject matter that applicants regard as their invention, it is believed the invention will be better understood when taken in connection with the accompanying drawings in which the sole FIGURE is a schematic representation of an air separation process and apparatus in accordance with the present invention.

DETAILED DESCRIPTION

With reference to the figure, compressed and purified air is filtered to remove dust by a filter 10. Thereafter, the air is compressed in a compressor 12. After removal of the heat of compression by an after-cooler 14, the air is purified within a prepurification unit 16. Prepurification unit 16 is employed to remove moisture carbon dioxide and hydrocarbons from the air. This is necessary to prevent ice formation and also to inhibit the retention of flammable hydrocarbons.

The resultant compressed and purified air stream 18 is then processed within a main heat exchanger 20. A first part 22 of compressed and purified air stream 18 is cooled in the main heat exchanger 20 to a temperature suitable for its rectification. This temperature is the temperature at which the distillation is conducted. As is well known in the art, main heat exchanger 20 is not necessarily a single heat exchanger and can be a heat exchanger complex. As illustrated, first part 22 of compressed and purified air stream 18 is formed by dividing compressed and purified air stream 18 into two parts within main heat exchanger 20 by provision of an intermediate outlet for a second part 23 of compressed and purified air stream 18. Such second part 23 is thus only partially cooled to a temperature intermediate the warm and cold ends of main heat exchanger 20. As can be appreciated compressed and purified air stream 18 could be divided prior to entry into main heat exchanger 20.

After cooling is complete, first part 22 of compressed and purified air stream 18, is divided into first and second subsidiary streams 24 and 26. First and second subsidiary streams 24 and 26 at a junction 25 are introduced into a single column nitrogen generator 28 to produce a liquid column bottoms in a bottom region 30 of distillation of single coltarm nitrogen generator 28 and a tower overhead in a top region 32 of distillation of single column nitrogen generator 28. In the illustrated embodiment, first subsidiary stream 24 is introduced into bottom region 30 and second subsidiary stream 26 is introduced above bottom region 30 to a location of single column nitrogen generator 28 having a like composition as the liquefied incoming air. Thus, single column nitrogen generator 28 has two regions of mass transfer contact elements 34 and 36 which can be a packing, either structured or random packing, or trays.

In order to reflux single column nitrogen generator 28, a coolant stream 38 is removed and valve expanded in a valve 40 to a temperature that will condense the stream of the tower overhead 42 within a head or reflux condenser 44. The result of such condensation is the vaporization of coolant stream 38 to produce a vaporized coolant stream 46. Reflux stream 48, which consists of condensed tower overhead, is reintroduced into top region 32 of single column nitrogen generator 28. Part of the liquid may be drawn as a liquid nitrogen product stream 50.

Liquid nitrogen product stream 50 may be taken as a product or, preferably as illustrated, is valve expanded within an expansion valve 52 (which can also be a cut-off valve) and flashed into a phase separation tank 54. Liquid phase stream 56 composed of the liquid phase can then be taken as a product and a vapor phase stream 58 can in turn be reduced in pressure by a pressure reduction valve 60 and then combined with vaporized coolant stream 46 to produce a waste stream 62. As can be appreciated by those skilled in the art, in the event that liquid product were taken without phase separation, then, waste stream 62 would be formed in its entirety by vaporized coolant stream 46.

In order to inhibit the production of vapor through the valve expansion by expansion valve 40, preferably, coolant stream 38 is subcooled in a subcooling unit 64. Waste stream 62 warms in subcooling unit 64 to at least help subcool coolant stream 38 prior to its valve expansion within expansion valve 40.

Waste stream 62 is then used as a coolant for a liquefier unit 65 used in liquefying second subsidiary stream 26. Thereafter, waste stream 62 is warmed to a temperature above the distillation temperature in the main heat exchanger 22.

As has been previously discussed, second part 23 of the compressed and purified air stream 18 is only partly cooled. After such partial cooling second part 23 is expanded within an expansion engine 66 which can be a turboexpander. Preferably, the exhaust of turbo expander 66 is at a pressure that is about equal to the pressure of waste stream 62 to allow for a combination of waste stream 62 with the now expanded first part of the compressed and purified air stream (designated by reference 68. ) This pressure could be the pressure of waste stream 62 after having been slightly warmed and after having passed through piping. Resultant combined waste stream 70 is then expanded within second turboexpander 71 to produce an expanded combined waste stream 72. Expanded combined waste stream 72 also passes through subcooler unit 64 to help subcool coolant stream 38 and then passes through liquefier 65 to liquefy second subsidiary stream 26. Thereafter, expanded combined waste stream 72 fully warms to the warm end temperature of main heat exchanger 20. As could be appreciated by those skilled in the art, expanded combined waste stream 72 could be utilized in its entirety to liquefy second subsidiary stream 26. In order to increase the degree of refrigeration produced, expander 71 expands combined waste stream 72 to a pressure that is below atmospheric. Expanded combined waste stream 72 is then dram by a blower unit 74 where it is expelled as waste nitrogen ($WN_2$). Although preferred, blower unit 74 is an optional feature of the present invention. Preferably, expanders 66 and 71, and blower 74 are coupled.

When excess liquid production is not desired, turbo expander 66 can be cut off or at least turned down in a manner well known in the art. In such case, substantially all of compressed and purified air stream 18 is cooled to rectification temperature. Second subsidiary stream 26 will be much smaller as only a small amount of liquefaction will take place in air liquefier unit 65. Additionally, since only waste stream 62 that is being expanded, less mass flow is being used to refrigerate the process and most of the resultant product is taken off as a gas ($GN_2$). Most of the resultant gaseous make is a stream 78 which warms in subcooling unit 64 and then fully warms within main heat exchanger 20 to warm end temperatures thereof. This is a preferred though optional feature of the present invention. The present invention also contemplates a single column generator designed for only a liquid make. Furthermore, even in the illustrated embodiment, when excess liquid production is desired, some of the product can be taken off as a gas by way of stream 78. In order to avoid any confusion, the inventors intend that all of the forgoing modes of operation are not to be excluded from the present invention as set forth in the pending claims.

Although the present invention has been described with reference to a preferred embodiment, as will occur to those skilled in the art, numerous changes, additions and omissions may be made without departing from the spirit and scope of the present invention.

We claim:

1. A process for separating air to produce a nitrogen product, said process including:

cooling a first part of a compressed and purified air stream to a temperature suitable for its rectification;

dividing said first part of said compressed and purified air stream into first and second subsidiary streams;

liquefying said second subsidiary stream;

introducing said first and second subsidiary streams into a single column nitrogen generator to produce a tower overhead and a liquid column bottoms;

condensing a stream of the tower overhead to produce a condensate;

employing part of the condensate to reflux the single column nitrogen generator and a remaining part of the condensate to form a liquid nitrogen product stream;

valve expanding a coolant stream formed from said liquid column bottoms and vaporizing said coolant stream against the condensation of the tower overhead, thereby to form said condensate and a vaporized coolant stream;

partly cooling a second part of the compressed and purified air stream to a temperature above said temperature suitable for the rectification of the first part of the compressed and purified air stream;

expanding said second part of the compressed and purified air stream with performance of work;

partially warming said second part of the compressed and purified air stream and a waste stream formed at least in part from said vaporized coolant stream;

forming a combined expanded waste stream by combining and then expanding with the performance of work said second part of the compressed and purified air stream and said waste stream;

fully warming said combined expanded waste stream by indirectly exchanging heat from said second subsidiary stream to said combined expanded waste stream, thereby to at least in part liquefy said second subsidiary stream, and by indirectly exchanging further heat from said first and second parts of the compressed and purified air stream, thereby to lower enthalpy of said first and second parts of the compressed and purified air stream; and forming at least part of the nitrogen product from the liquid nitrogen product stream.

2. The process for claim 1, wherein:

said combined expanded waste stream has a subatmospheric pressure; and said combined expanded waste stream is pressurized for atmospheric discharge.

3. The process for claim 1, wherein:

said coolant stream, prior to valve expansion, is subcooled by engaging in indirect heat transfer with said expanded combined stream and vaporized coolant stream; and said second subsidiary stream also indirect exchanges still further heat to said waste stream to accomplish the liquefaction of said second subsidiary stream.

4. The process for claim 1, wherein:

said liquid nitrogen product stream is flashed and phase separated to form liquid and vapor phases;

said nitrogen product is formed from said liquid phase; and a vapor stream composed of the vapor phase is combined with the vaporized coolant stream to form said waste stream.

5. An apparatus for separating air to produce a nitrogen product, said apparatus including:

main heat exchange means configured for cooling a first part of a compressed and purified air stream to a temperature suitable for its rectification, for partly cooling a second part of the compressed and purified air stream to a temperature above said temperature suitable for the rectification of the first part of the compressed and purified air stream, and for partially warming said second part of the compressed and purified air stream and a waste stream formed at least in part from a vaporized coolant stream;

a junction for dividing said first part of said compressed and purified air stream into first and second subsidiary streams;

liquefaction means configured to liquefy said second subsidiary stream;

a single column nitrogen generator connected to said junction and said liquefaction means to receive said first and second subsidiary streams and configured to produce a tower overhead and a liquid column bottoms;

a head condenser connected to said single column nitrogen generator and configured to condense a stream of the tower overhead, thereby to produce a condensate, to vaporize a coolant stream formed from said liquid column bottoms, thereby to form a vaporized coolant stream and to return a reflux stream to said single column nitrogen generator, thereby to reflux the single column nitrogen generator from part of the condensate;

an expansion valve interposed between said head condenser and said single column nitrogen generator to valve expand said coolant stream;

first expansion means for expanding said second part of the compressed and purified air stream with performance of work;

second expansion means connected to said main heat exchange means for expanding with performance of work said second part of the compressed and purified air stream and said waste stream and for producing a combined waste stream;

said liquefaction means connected to said second expansion means and said main heat exchange means connected to said liquefaction means;

said main heat exchange means and said liquefaction means configured to indirectly exchange heat from said second subsidiary stream to said combined expanded waste stream, thereby to at least in part liquefy said second subsidiary stream, and to indirectly exchange further heat from said first and second parts of the compressed and purified air stream to said combined expanded waste stream, thereby to lower enthalpy of said first and second parts of the compressed and purified air stream and fully warm said combined expanded waste stream; and means connected to said single column nitrogen generator for forming at least part of a nitrogen product from a liquid nitrogen product stream composed of a remaining part of the condensate.

6. The apparatus of claim 5, further comprising a blower in communication with said second expansion means to pressurize said combined expanded waste stream.

7. The apparatus of claim 5, further comprising:

subcooler means interposed between said expansion valve and said single column nitrogen generator for indirectly transferring heat between said coolant stream and said expanded combined stream and said vaporized coolant stream, thereby to subcool said coolant stream; and said main heat exchange means and liquefaction means configured to indirectly exchange heat from said second subsidiary stream to also said waste stream.

8. The apparatus of claim 5, wherein:

said nitrogen product forming means includes a phase separation tank connected said single column nitrogen generator for phase separating said liquid nitrogen product stream, thereby to form liquid and vapor phases;

said phase separator having an outlet to discharge said liquid phase, thereby to form said nitrogen product; and said phase separator connected to said head condenser so that a vapor stream composed of said vapor phase combines with said vaporized coolant stream.

* * * * *